US007475508B1

(12) United States Patent
Walker

(10) Patent No.: US 7,475,508 B1
(45) Date of Patent: Jan. 13, 2009

(54) INFLATABLE ELECTRICAL SHOCKING WEAPON

(76) Inventor: Brian W. Walker, 21165 Sottsdale Dr., Bend, OR (US) 97701

( * ) Notice: Subject to any disclaimer, the term of this patent is extended or adjusted under 35 U.S.C. 154(b) by 359 days.

(21) Appl. No.: 11/288,709

(22) Filed: Nov. 28, 2005

Related U.S. Application Data

(60) Provisional application No. 60/631,889, filed on Dec. 1, 2004.

(51) Int. Cl.
*F41C 9/00* (2006.01)

(52) U.S. Cl. ..... 42/84; 42/1.08; 89/1.11

(58) Field of Classification Search ..... 42/1.08, 42/1.16, 84, 70.01; 89/1.11
See application file for complete search history.

(56) References Cited

U.S. PATENT DOCUMENTS 5,529,300 A * 6/1996 Frazier et al. ..... 463/47.4
2001/0012918 A1* 8/2001 Swanson ..... 600/510

* cited by examiner

*Primary Examiner*—Stephen M Johnson
(74) *Attorney, Agent, or Firm*—Andrew F. Knight

(57) ABSTRACT

An inflatable electrical shocking weapon includes a hand portion, an inflatable extension configured to extend to an extension length upon inflation, and an electrical shocking device. The electrical shocking device includes a portable power source, a high-voltage generator connected to and configured to generate a high voltage from the portable power source, and at least two electrically conductive leads connected to the generator and configured to pass a current from the generator through a human at least when the human contacts the leads. The electrically conductive leads are connected to an end of the inflatable extension opposing the hand portion.

19 Claims, 3 Drawing Sheets

INFLATABLE ELECTRICAL SHOCKING WEAPON

REFERENCE TO RELATED APPLICATION

The present application claims priority to U.S. Patent Application No. 60/631,889, filed Dec. 1, 2004, entitled "Inflatable Electrical Shocking Weapon," the disclosure of which is hereby incorporated by reference.

BACKGROUND

Electrical shocking devices are well known in the art, and include "stun guns" and "tasers." A stun gun is capable of providing an extremely high voltage across two electrically conductive terminals, and designed to shock and neutralize an enemy when the stun gun is activated while the terminals are in contact with the enemy's body. A problem with stun guns is that they are typically small handheld devices in which the terminals are merely a few inches from the user's hand, necessitating that the user is very close to the enemy before the stun gun can be used against the enemy. Tasers are devices that, in at least one embodiment, shoot two electrically conductive dart-like projectiles at an enemy. Because the high voltage generator is typically located in the portion of the taser maintained by the user, a taser includes long wires running the distance from the handheld portion to the electrically conductive dart-like projectiles. Once the taser has been successfully fired at an enemy and both darts are lodged in the enemy's skin, the handheld portion generates an extremely high voltage that is delivered to the darts (and, hence, the enemy) via the long wires. While tasers solve one problem with stun guns—namely, the need for close proximity to an enemy—they are accompanied by several disadvantages. First, they are effectively single-use devices such that, if the user fails to lodge both darts into the enemy's skin, the taser must be reloaded before it may be used again. Second, they are good against only one enemy, until the taser is reloaded for another enemy.

U.S. Pat. No. 4,719,534 to Ward discloses an electric shock safety device that has an extending or telescoping probe which provides a means for the safe, efficient, rapid and accurate deployment of the device. Ward discloses that the device is especially suited for protection for joggers and bicyclists from dogs or other animals. The probe has three sections 14', 14", and 14'", and the device may extend to three feet. There are several problems with the device of Ward. First, to obtain a desired extended length, such as three feet, either each section must be prohibitively long (e.g., one foot each, for three segments), or the device must include prohibitively many shorter concentric sections, which adds weight, complexity, and risk of device failure. Second, even if the sections are made of a relatively lightweight material, such as a hard plastic, the device may still be too heavy to comfortably carry around—particularly by joggers, as suggested by Ward.

SUMMARY OF THE INVENTION

The present invention aims to solve one or more of these and other problems.

According to an embodiment of the present invention, an inflatable electrical shocking weapon comprises: a hand portion; an inflatable extension configured to extend to an extension length upon inflation; and an electrical shocking device comprising: a portable power source; a high-voltage generator connected to and configured to generate a high voltage from the portable power source; and at least two electrically conductive leads connected to the generator and configured to pass a current from the generator through a human at least when the human contacts the leads, wherein the electrically conductive leads are connected to an end of the inflatable extension opposing the hand portion.

DETAILED DESCRIPTION

The disclosure of U.S. Pat. No. 4,719,534 to Ward is hereby incorporated by reference to the extent necessary to understand the present invention.

In the following description, the use of "a," "an," or "the" can refer to the plural. All examples given are for clarification only, and are not intended to limit the scope of the invention.

Stun guns are well known in the art, and are typically hand-held portable devices containing a power source (usually a battery, such as a 9-volt battery), a circuit (typically a transformer) configured to produce from the low-voltage power source a very high voltage (typically at least 20 kV, but often well above 100 kV), and electrically conductive leads positioned so that the leads may be pressed against an enemy's body to deliver the very high voltage to the enemy. Stun guns usually include a switch which, when closed, causes the transformer to generate the high voltage. They also often include two "warning" leads, usually connected to the aforementioned electrically conductive leads, that are spaced apart a distance less than is necessary for the high voltage to ionize air. In other words, if the stun gun leads are not in contact with a human person, and the activation switch is closed, then the generated high voltage is sufficiently high to ionize air between the warning leads and thus induce a current—i.e., an arc or "lightning bolt"—across the warning leads. The result is a loud "pop" accompanied by a bright flash that would repel even the least intelligent perpetrator. The very high voltage created by stun guns, when used to induce a current through a human body, causes the body to lose control of its muscles, and thus can neutralize a perpetrator. Because stun guns, and their methods of producing very (very) high voltages (typically with very low currents) capable of neutralizing a human, are so well known in the art, no further discussion will be offered of their design or components.

Figure 1A:
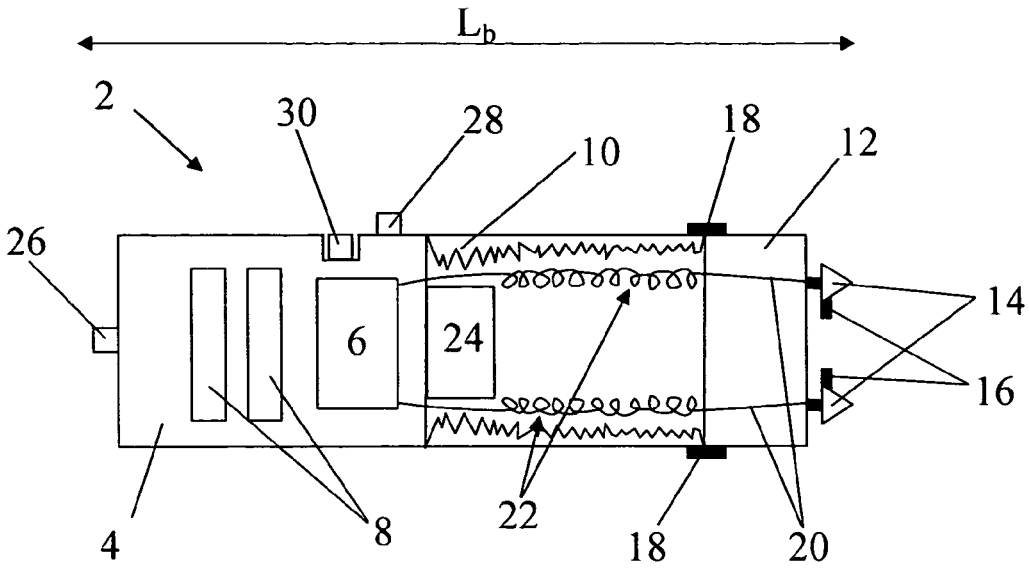
FIG. 1*a* shows a cross sectional view of an inflatable electrical shocking weapon according to one embodiment, the weapon in an uninflated state.
Figure 1B:
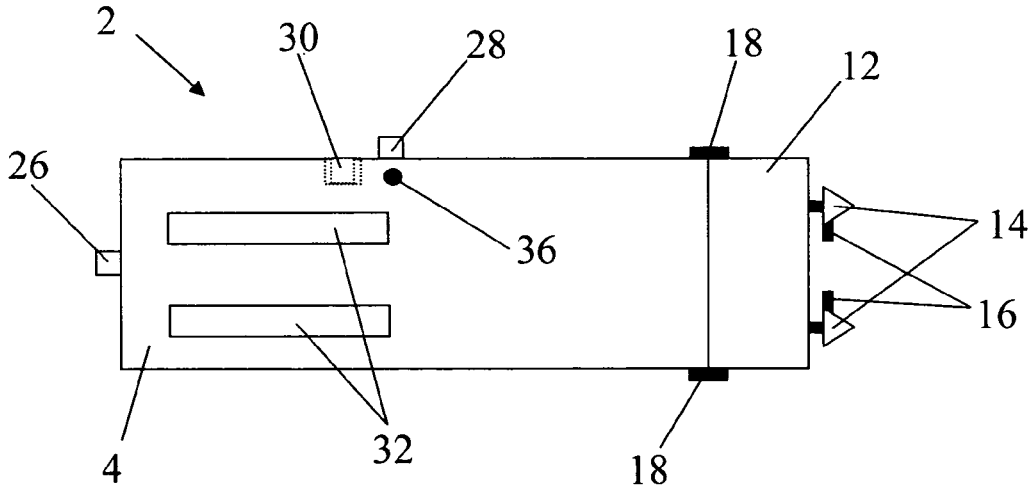
FIG. 1*b* shows a side view of the weapon shown in FIG. 1*a*.

Referring now to FIGS. 1*a* and 1*b*, an inflatable electrical shocking weapon 2 comprises a hand portion 4, an inflatable extension 10 configured to extend to an extension length $L_e$ (FIG. 3) upon inflation, and an electrical shocking device comprising a portable power source 8, a high-voltage generator 6 connected to and configured to generate a high voltage from the portable power source 8, and at least two electrically conductive leads 14 connected to the generator 6 and configured to pass a current from the generator 6 through a human at least when the human contacts the leads 14. The weapon 2 may further comprise an end 12 of the inflatable extension 10 opposing the hand portion 4, a connector 18 configured to connect the end 12 to the hand portion 4, warning leads 16 preferably connected to the leads 14, wires 20 extending from the generator 6 to the leads 14, 16, a stretchable portion 22 of wires 20, a high-pressure gas source 24, and a series of switches 26, 28, 30, 32.

The weapon 2 in an uninflated or before-inflation state has a length $L_b$ as shown. Length $L_b$ is preferably not more than approximately one foot, preferably not more than approximately 10 inches, preferably not more than approximately 8 inches, and preferably not more than approximately 6 inches.

The hand portion 4 may comprise any hard material known, such as a metal or plastic, but is preferably electrically nonconductive to prevent the likelihood of short circuit or shock to the user. The end 12 may or may not comprise a similar substance. Portable power source 8 is preferably a storable source of electrical energy, and may comprise batteries of any kind (e.g., chemical batteries, such as rechargeable batteries), capacitors, etc. Any portable source of power known in the art that may be used as portable power source 8 is within the scope of the present invention. The portable power source 8 may comprise typical chemical batteries that are readily replaceable, or may comprise rechargeable batteries that may be recharged via a charging jack (not shown), or other means of maintaining the batteries' charge, such as a photovoltaic cell (not shown) that provides a relatively constant supply of maintenance charge to the power source 8 via sunlight or artificial light. High-voltage generator 6 may include any electrical device capable of generating a very high voltage, preferably at least 5 kV, preferably at least 20 kV, preferably at least 50 kV, preferably at least 100 kV, preferably at least 200 kV, preferably at least 300 kV, from the relatively low voltage power source 8. As an example but not a limitation, high voltage generator 8 comprises a transformer. The high voltage generator 6 may alternatively or in addition comprise a high voltage capacitor to store a high voltage charge for ready delivery to an enemy.

End 12 is connected to the hand portion 4 via connector(s) 18. Connector 18 may comprise, e.g., a ring of a mildly compressible or tensile material, such as a rubber or plastic, that extends around an outer diameter of the hand portion 4, having an inner diameter just slightly smaller than an outer diameter of the end 12, so that when the end 12 is pushed against the hand portion 4 inside connector 18, connector 18 expands slightly to accommodate the end 12, and the end 12 is maintained connected to the hand portion 4 by friction of the connector 18 against the end 12. One of ordinary skill in the art will recognize thousands of other options for connector 18, and all connectors known in the art are within the scope of the present invention. Connector 18 may be at least one of two types. A first type of connector 18, consistent with the example just given, is one that will release when a sufficient force (such as, as will be seen, the inflatable extension 10 is in the process of inflating, causing a pressure force to be exerted on the end 12, thus pushing the end 12 away from the hand portion 4 and releasing the connector 18) is applied to the end 12 in a direction opposite the hand portion 4. A second type of connector 18 is much more secure, and will not release merely by inflation of the inflatable extension 10—rather, an additional action, such as pressing a mechanical release button, is required. In the latter case, the weapon 2 may include a pressure relief valve 34 (shown in FIG. 2) to allow the pressure inside the inflatable extension 10 to be relieved in the case that the high-pressure gas source 24 is activated, but the connector 18 is not released to allow the end 12 to separate from the hand portion 4. Both types of connectors 18, specific examples of which are well known, are within the scope of the present invention.

Electrically conductive leads 14 are configured to deliver a high voltage electric shock to an enemy in contact with the leads 14, and may comprise any electrically conductive material, as known in the art. Warning leads 16 may be spaced more closely together than leads 14, as shown, so as to provide a short-circuit path for the high voltage current induced by the generator 6, in the case that the leads 14 are not in contact with the body of an enemy. For example, the distance between the warning leads 16, as understood by one of ordinary skill in the art, should be less than the maximum distance through which the high voltage generated by generator 6 may ionize air—otherwise, the voltage would not be sufficiently high to cause an arcing of electrical current across the warning leads 16.

Figure 3:
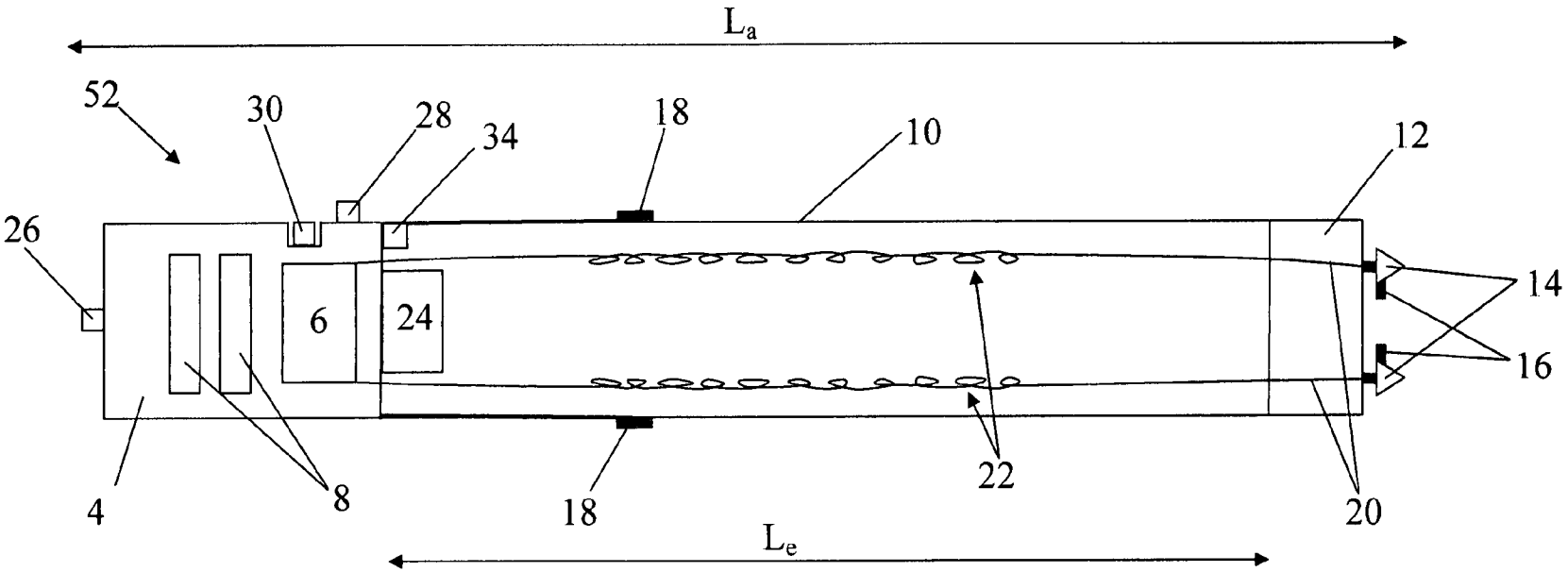
FIG. 3 shows a cross sectional view of an inflatable electrical shocking weapon according to another embodiment, the weapon in a fully inflated state.

Leads 14, 16 are electrically connected to the generator 6 via electrically conducting wires 20, which may comprise any electrically conducting material. In the embodiment shown in FIG. 1*a*, wires 20 are coiled up relatively free or unconnected to the inflatable extension 10. The wires 20 may be orderly coiled, such as in the form of a coiled spring, such as in stretchable portion 22, so that when the weapon 2 is in the uninflated state, there is little or no risk of wires 20 touching each other, or even of coming sufficiently close to each other that a short circuit could develop between the wires 20 (instead of warning leads 16) via ionization of air inside the inflatable extension 10. An example of what the wires 20 might look like when the weapon 2 is in the inflated state is shown in FIG. 3. In FIG. 3, the stretchable portions 22, which may be spring-like, have been stretched, and provide a tension on the wires 20 so that the wires 20, as a whole, are substantially straight, thus maintaining a safe distance (preferably much greater than the distance between warning leads 16) between the wires 20. Of course, wires 20 need not be so orderly coiled, but otherwise it may make the weapon 2 inoperable as a stun gun when in the uninflated state.

The high-pressure gas source 24 is a source of a high-pressure gas to fill and inflate the inflatable extension 10, and may comprise any such source known in the art. For example, high-pressure gas source 24 may comprise a high-pressure gas container configured to release a high-pressure gas to inflate the inflatable extension 10. The container may contain any high-pressure gas, preferably a relatively inert and readily available gas, such as air. Further, the container may be configured to be recharged with an air compressor or pump, such as by including a valve (not shown) accessible from the weapon's exterior, to which the air compressor or pump may be connected to pressurize or recharge the high-pressure gas source 24. The valve could, for example, be similar to those used on automobile and bicycle tires, so that the high-pressure gas source 24 can easily be pressurized or recharged with a conventional air compressor or pump-e.g., even a conventional bicycle pump. The container may also include a pressure gauge or pressure relief valve (not shown) so that the high-pressure gas source 24 cannot be pressurized above a certain predetermined maximum safe working pressure, to which the pressure relief valve may be set to relieve pressure. Alternatively, instead of being able to recharge the high-pressure gas source 24 by using a pump or compressor, the high-pressure gas source 24 may comprise a readily exchangeable/replaceable high-pressure gas container which, once used to inflate the inflatable extension 10, may be removed, disposed of, and replaced with another high-pressure gas container.

In another embodiment, high-pressure gas source 24 may comprise an igniter (such as an electrical igniter, such as an electric heating squib, or an electrical spark-type igniter, or a friction-type igniter, as known in the art) and a pyrotechnic gas generator (such as a deflagratable explosive, such as smokeless powder, or a mixture of a chemical oxidizer and fuel, such black powder or a mixture of a nitrate, chlorate, perchlorate, etc., with a carbon or hydrocarbon fuel, etc.), configured to generate sufficient high-pressure gas inside the inflatable extension 10 to inflate the inflatable extension 10. The pyrotechnic gas generator and/or igniter may be readily replaceable so that the weapon 2 may be used multiple times. High-pressure gas source 24 may comprise any other device configured to generate a high-pressure gas sufficient to inflate the inflatable extension 10 and/or to detach the end 12 from the hand portion 4, such as a powerful fan, and preferably is configured to inflate the inflatable extension 10 in a very short time, such as not more than one or half a second.

The switches 26, 28, 30, 32 may or may not be configured to: allow generation of the high voltage ("activation") independently of inflation ("inflation") of the inflatable extension 10; reduce risk of unintentional activation and/or inflation, such as by placing two or more of the switches in series, and/or by configuring one or more of the switches as open-biased, and/or by configuring one or more of the switches so that closing of the switch(es) is not easy (e.g., by recessing one or more of the switches), and so forth.

One possible configuration of the switches will be described with respect to FIGS. 1*a* and 1*b*. Switch 26 may be a conventional electrical on-off switch, not necessarily biased open or closed, so that a user may simply prevent activation and/or inflation by turning the switch off (i.e., opening the switch). Next, one switch may comprise an electronic switch comprising at least two electrical conductors 32, such that the electrical switch is configured to be closed when a human hand simultaneously contacts the at least two electrical conductors 32. For example, the switch may include circuitry (not shown) configured to measure an electrical resistance across the conductors 32. Human skin conducts some electricity, in part because of sweat on the hand and ionic compounds dissolved in the sweat. Ranges for the resistance across about an inch of two (i.e., the distance separating conductors 32) of the skin on a human hand is known. When the resistance falls within this range, the circuitry may be configured to electronically (e.g., via a transistor) or electromechanically (e.g., via a relay) close the switch. Thus, the switch represented by conductors 32 may be a safety switch that is electronically in series with at least one of the other switches (e.g., 28, 30) so as to prevent activation or inflation unless a human hand is tightly holding the hand portion 4 (and thus making contact with both conductors 32).

Switch 28 may be an open-biased (e.g., spring-loaded open) switch that protrudes from the hand portion 4. The switch 28 may, e.g., be part of a circuit in which the switch 28 is in series with switches 26 and 32 such that simultaneous closure of all three switches activates the weapon (such that the high-voltage generator 6 generates the high voltage across leads 14). Further, switch 30 may or may not also be an open-biased switch, that preferably is recessed within the hand portion 4 as shown, so that ease of closing the switch 30 is restricted. The switch 30 may, e.g., be part of a circuit in which the switch 30 is in series with switches 26 and 32 such that simultaneous closure of all three switches inflates the inflatable extension 10 by causing the high-pressure gas source 24 to release high-pressure gas into the extension 10. The switch 30 may also cause the weapon 2 to activate, preferably timed to activate the weapon 2 after full inflation of the weapon's extension 10, so that a user does not have to first press button/switch 30 and then button/switch 28—he may instead just hold down the button/switch 30 to both inflate and activate the weapon 2. The weapon 2 may include more or fewer switches than shown, and the switches 26, 28, 30, 32 may be configured in different ways than shown and/or described, such as only two switches being present in each of the series circuits, or both switches 28, 30 being recessed, and so forth.

One or more of the switches 26, 28, 30, 32 may be mechanical (or pneumatic or hydraulic) instead of electrical. For example, for the switch 30 that causes the high-pressure gas source 24 to release the gas, the switch may comprise a lever having a sharp tip that is configured to pierce a rupture disk on the high-pressure gas source that prevents release of the gas until its rupture. Further, one or more of the switches 26, 28, 30, 32 may include a mechanical safety 36 (FIG. 1*b*) that is configured to prevent the pressing or closing of its corresponding switch unless the safety 36 is released. The safety 36 may, e.g., comprise a simple pin that must be shifted to allow the switch (e.g., switch 28) to be pressed or closed.

Inflatable extension 10 may comprise any soft material that is substantially gas impermeable, and preferably has a tube-shape such that the extension 10 is soft and flimsy when uninflated but hard and stiff when inflated to a sufficient pressure. The extension 10 may, e.g., comprise a paper, plastic, rubber, Nylon, etc., and may, if this material is not already substantially gas impermeable, be coated on the inside or outside with a gas impermeable material. Further, the extension 10 preferably has an inflated diameter of not more than approximately 3 inches, preferably not more than approximately two inches, and more preferably not more than approximately 1.5 inches.

Figure 2:
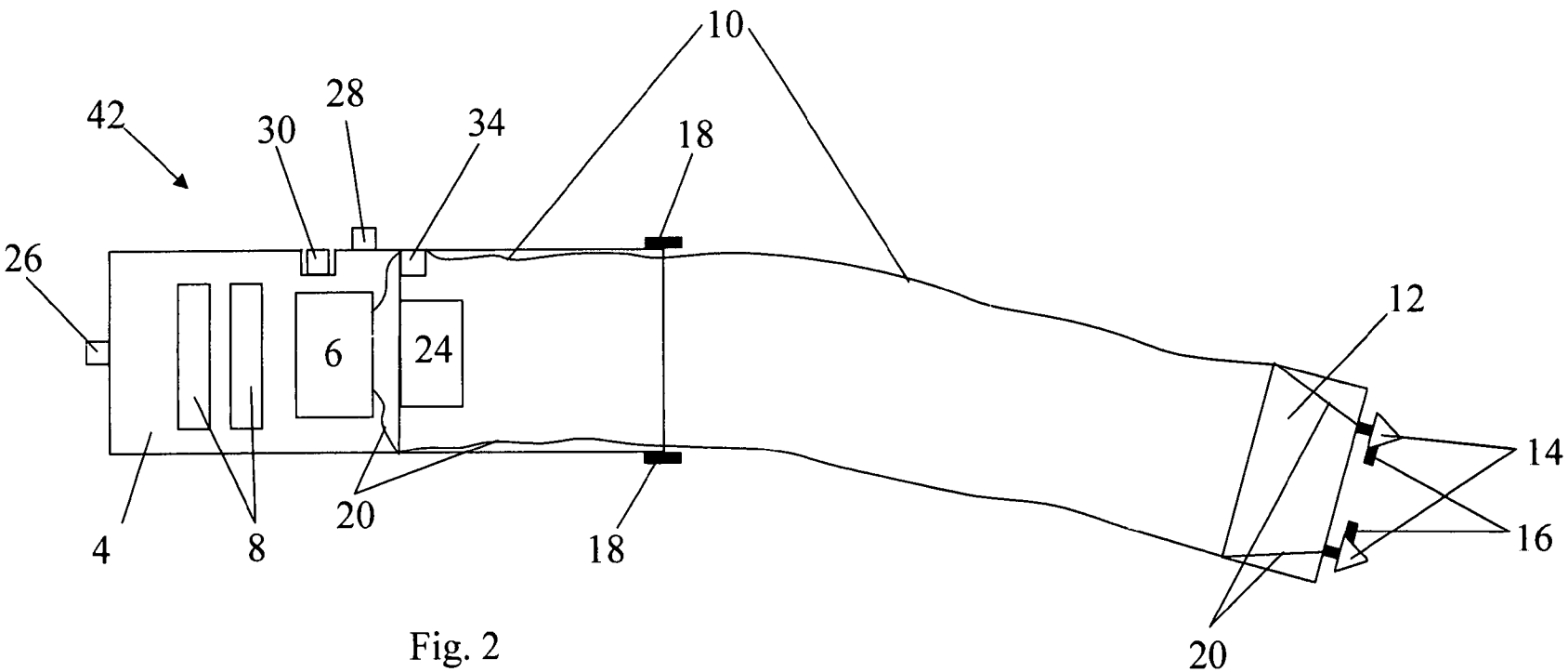
FIG. 2 shows a cross sectional view of an inflatable electrical shocking weapon according to another embodiment, the weapon in a partially inflated state.

Referring now to FIG. 2, another embodiment of an inflatable electrical shocking weapon 42 is shown. The inflatable extension 10 of the weapon 42 is mostly, but not fully, inflated in FIG. 2. The weapon 42 includes many of the same features of the embodiment shown in FIGS. 1*a* and 1*b*, with these exceptions. First, the weapon 42 comprises a pressure relief valve and/or a pressure release valve, both of which are indicated by reference number 34. A pressure release valve may comprise a user operated valve that is operable by a user to allow the user to deflate the inflatable extension 10 after inflation so that the weapon 42 may be reused. The user operated valve may be a simple mechanical valve (such as a press-button closed-biased valve, which may be similar to a conventional car or bicycle tire valve), or may be an electrical valve (e.g., solenoid valve), or any other valve known in the art. The pressure release valve allows the user, after use of the weapon 42, to easily deflate the inflatable extension 10, connect the end 12 to the hand portion 4, recharge the high-pressure gas source 24, and subsequently reuse if desired. Alternatively or in addition, reference number 34 may refer to a pressure relief valve that may be configured to prevent a pressure inside the inflatable extension 10 from exceeding a maximum allowable pressure, so as to prevent the risk of explosion of the extension 10 or weapon 42 during or after release of gas by the high-pressure gas source 24. The pressure relief valve may comprise a spring-loaded safety valve, a burst-disk-type relief valve, or any other relief valve known in the art.

Second, the wires 20 may be located in or attached or connected to side walls of the inflatable extension 10, preferably at opposing sides, thus eliminating the problems associated with freely extending wires 20 (FIG. 1*a*) that may be tensioned by stretchable portions 22. For example, wires 20 may be simply connected to opposing internal sides of the inflatable extension 10 by using an adhesive tape, or other connector known in the art.

In the embodiment shown in FIG. 2, the weapon 42 may also include an inner tube (not shown) attached to the hand portion 4, located concentrically about its outer tube, and configured so that the inflatable extension 10 may be crumpled up between the inner and outer tube when the weapon 42 is in the uninflated state (e.g., in FIG. 1*a*). An advantage to such a tube is twofold: a) it would help to prevent a random twisting and crumpling of the extension 10 when the user deflates the weapon 42 and connects the end 12 to the hand portion 4 for late reuse of the weapon 42; and b) it would help to maintain a safe distance (i.e., at least the diameter of the inner tube) between the wires 20 that run along and/or are connected to opposing sides of the inflatable extension 10. This "safe distance" is greater than the distance between warning leads 16, so that the uninflated weapon 42 may be used as an ordinary stun gun.

Referring now to FIG. 3, another embodiment of an inflatable electrical shocking weapon 52 is shown. The inflatable extension 10 of the weapon 52 is fully inflated in FIG. 3. The weapon 52 has an after-inflation length $L_a$ that is preferably at least approximately 2 feet, more preferably at least approximately 2.5 feet, more preferably at least approximately 3 feet, and more preferably at least approximately 4 feet. Further, the inflatable extension 10 has an after-inflation length $L_e$ that is preferably at least approximately 1 foot, more preferably at least approximately 1.5 feet, more preferably at least approximately 2 feet, and more preferably at least approximately 3 feet.

The weapon 52 may include many of the same features of the embodiments shown in FIGS. 1*a*, 1*b*, and 2. More particularly, the wire 20 configuration shown in FIG. 3 corresponds to that shown in FIG. 1*a*, where the wires 20 in FIG. 3 are stretched out due to inflation of the inflatable extension 20, with the stretchable portion 22 providing sufficient tension on the wires 20 such that they are substantially straight when the extension 10 is inflated. Of course, if the wires 20 were in FIG. 3 as shown in FIG. 2, the wires 20 may be located on or connected to opposing sides of the extension 10, in which case there may be no need for a stretchable portion 22.

Operation of the weapons 2, 42, 52 ("the weapon") may be relatively straightforward, given the previous description. In the uninflated configuration, as shown in FIG. 1*a*, the weapon may be operated as an ordinary stun gun by closing the appropriate switches. For example, the stun gun may be activated by turning on the switch 26, tightly gripping the hand portion 4 (to close the switch 32) and pressing the open-biased switch/button 28. The weapon may be turned into a "stun wand" by inflating the weapon's extension 10. For example, the extension 10 may be inflated by, with the switch 26 turned on and the hand portion 4 tightly gripped (maintaining the switch 32 in the closed configuration), pressing the recessed switch 30. This may cause the high-pressure gas source 24 to release sufficient gas into the extension 10 to completely inflate the extension 10, as shown in FIG. 3. Then, the weapon may be activated to generate a high voltage across the leads 14 to allow the stun wand to shock an enemy, such as by closing the switch 28 with switches 26, 32 closed. The high-pressure gas source 24 may be configured to inflate the extension 10 in a short period of time, such as less than about 2 seconds, preferably less than about 1 second, and more preferably less than about 0.5 seconds.

After inflation of the extension 10, the extension 10 may be deflated by opening the pressure release valve 34 and pushing the end 12 toward the hand portion 4 while putting the deflating extension 10 inside the hand portion 4. The end 12 may then be connected to the hand portion 12 via connector 18, and the high-pressure gas source 24 may be replaced and/or recharged, so that the extension 10 may be inflated again for a later use.

Most of the embodiments described herein have represented simple versions for clarity of explanation. As understood by one of ordinary skill in the art, many of the features and/or aspects of the embodiments described herein may be "mixed and matched" to the extent physically possible to satisfy individual design requirements. Further, variations on the above discussed embodiments are within the scope of the present invention.

I claim:

1. A method of using a weapon comprising:

providing an inflatable electrical shocking weapon, the weapon comprising:

a hand portion;

an inflatable extension configured to extend to an extension length upon inflation; and an electrical shocking device comprising:

a portable power source;

a high-voltage generator connected to and configured to generate a high voltage from the portable power source; and at least two electrically conductive leads connected to the generator and configured to pass a current from the generator through a human at least when said human contacts said leads, wherein the electrically conductive leads are connected to an end of the inflatable extension opposing the hand portion;

contacting the at least two electrically conductive leads to the human; and passing current through the human to thereby neutralize the human.

2. The method as claimed in claim 1, wherein said extension length is at least approximately 1.5 feet.

3. The method as claimed in claim 1, wherein a length of the weapon before inflation is not more than approximately one foot, and a length of the weapon after inflation is at least approximately two feet.

4. The method as claimed in claim 1, wherein the weapon further comprises a high-pressure gas container configured to release gas to inflate the inflatable extension.

5. The method as claimed in claim 4, wherein the high-pressure gas container is configured to be recharged with an air compressor.

6. The method as claimed in claim 1, wherein the weapon further comprises a pyrotechnic gas source configured to inflate the inflatable extension.

7. The method as claimed in claim 1, wherein the weapon further comprises at least two switches connected in series, whereby the electrical shocking device will not generate the high voltage unless said at least two switches are in a closed configuration, wherein at least one of said at least two switches is open-biased and recessed in said hand portion.

8. The method as claimed in claim 1, wherein the electrical shocking device is configured to be capable of generating the high voltage when said inflatable extension is not inflated.

9. The method as claimed in claim 1, wherein the inflatable extension comprises a substantially gas impermeable material.

10. The method as claimed in claim 1, wherein the weapon further comprises a pressure relief valve configured to prevent a pressure inside said inflatable extension from exceeding a maximum allowable pressure.

11. The method as claimed in claim 1, wherein the inflatable extension comprises a soft tube having a diameter not more than approximately two inches, wherein the soft tube is configured to stiffen upon inflation.

12. The method as claimed in claim 1, wherein the electrically conductive leads are connected to said end of the inflatable extension via wires that are connected to and substantially run alongside opposing sides of the inflatable extension.

13. The method as claimed in claim 1, wherein the electrically conductive leads are connected to said end of the inflatable extension via stretchable wires, configured so that said wires are pulled taut and substantially straight when said inflatable extension is inflated.

14. An inflatable electrical shocking weapon, comprising:
a hand portion;
an inflatable extension configured to extend to an extension length upon inflation; and
an electrical shocking device comprising:
a portable power source;
a high-voltage generator connected to and configured to generate a high voltage from the portable power source; and
at least two electrically conductive leads connected to the generator and configured to pass a current from the generator through a human at least when said human contacts said leads,
wherein the electrically conductive leads are connected to an end of the inflatable extension opposing the hand portion, and
further comprising at least two open-biased switches connected in series, whereby the electrical shocking device will not generate the high voltage unless a user actively maintains said at least two switches in a closed configuration.

15. The inflatable electrical shocking weapon as claimed in claim 14, wherein at least one of said switches is an electronic switch comprising at least two electrical conductors, wherein the electrical switch is configured to be closed when a human hand simultaneously contacts said at least two electrical conductors.

16. An inflatable electrical shocking weapon, comprising:
a hand portion;
an inflatable extension configured to extend to an extension length upon inflation; and
an electrical shocking device comprising:
a portable power source;
a high-voltage generator connected to and configured to generate a high voltage from the portable power source; and
at least two electrically conductive leads connected to the generator and configured to pass a current from the generator through a human at least when said human contacts said leads,
wherein the electrically conductive leads are connected to an end of the inflatable extension opposing the hand portion, and
further comprising at least two open-biased switches, a first of said switches configured to cause said inflatable extension to inflate, and a second of said switches configured to cause the electrical shocking device to generate the high voltage.

17. The inflatable electrical shocking weapon as claimed in claim 16, wherein the first of said switches is also configured to cause the electrical shocking device to generate the high voltage, and the second of said switches is not configured to cause the inflatable extension to inflate.

18. An inflatable electrical shocking weapon, comprising:
a hand portion;
an inflatable extension configured to extend to an extension length upon inflation; and
an electrical shocking device comprising:
a portable power source;
a high-voltage generator connected to and configured to generate a high voltage from the portable power source; and
at least two electrically conductive leads connected to the generator and configured to pass a current from the generator through a human at least when said human contacts said leads,
wherein the electrically conductive leads are connected to an end of the inflatable extension opposing the hand portion, and
further comprising a pressure release valve, operable by a user, configured to allow said inflatable extension to be deflated after inflation so that said weapon may be reused.

19. An inflatable electrical shocking weapon, comprising:
a hand portion;
an inflatable extension configured to extend to an extension length upon inflation; and
an electrical shocking device comprising:
a portable power source;
a high-voltage generator connected to and configured to generate a high voltage from the portable power source; and
at least two electrically conductive leads connected to the generator and configured to pass a current from the generator through a human at least when said human contacts said leads,
wherein the electrically conductive leads are connected to an end of the inflatable extension opposing the hand portion, and
further comprising:
at least one switch configured to cause at least one of inflating said inflatable extension and generating said high voltage; and
a mechanical safety configured to prevent a user from closing said switch unless said mechanical safety is in an off configuration.

* * * * *